US012473052B2

(12) United States Patent
Grall

(10) Patent No.: US 12,473,052 B2
(45) Date of Patent: Nov. 18, 2025

(54) SYSTEM FOR HANDLING MARINE OR UNDERWATER DRONES BY FLOATING PONTOON WITH REMOVABLE DRONE INTERFACE MODULE, ADAPTED SHIP

(71) Applicant: IXBLUE, Saint-Germain-en-Laye (FR)

(72) Inventor: Sébastien Grall, Saint-Germain-en-Laye (FR)

(73) Assignee: EXAIL, Saint-Germain-en-Laye (FR)

( * ) Notice: Subject to any disclaimer, the term of this patent is extended or adjusted under 35 U.S.C. 154(b) by 565 days.

(21) Appl. No.: 17/912,396

(22) PCT Filed: Mar. 12, 2021

(86) PCT No.: PCT/EP2021/056321
§ 371 (c)(1),
(2) Date: Sep. 16, 2022

(87) PCT Pub. No.: WO2021/185689
PCT Pub. Date: Sep. 23, 2021

(65) Prior Publication Data

US 2023/0139862 A1 May 4, 2023

(30) Foreign Application Priority Data

Mar. 16, 2020 (FR) ..... 2002568

(51) Int. Cl.
*B63B 1/10* (2006.01)
*B63B 27/16* (2006.01)
*B63B 35/00* (2020.01)

(52) U.S. Cl.
CPC ..... *B63B 1/107* (2013.01); *B63B 27/16* (2013.01); *B63B 2027/165* (2013.01); *B63B 2035/006* (2013.01)

(58) Field of Classification Search
CPC ..... B63B 1/107; B63B 1/121; B63B 27/16; B63B 27/36; B63B 2027/165; B63B 2035/006; B63C 3/12; B63G 2008/002
(Continued)

(56) References Cited

U.S. PATENT DOCUMENTS 3,448,712 A * 6/1969 Adams, Jr. ..... B63C 1/02 114/259
4,276,846 A * 7/1981 Anderson ..... B63C 7/10 114/123

(Continued)

FOREIGN PATENT DOCUMENTS

| | | |
|---|---|---|
| KR | 10-2034174 | 11/2019 |
| WO | 2017/146583 | 8/2017 |
| WO | 2019/231324 | 12/2019 |

OTHER PUBLICATIONS

International Search Report for PCT/EP2021/056321 dated Jun. 23, 2021, 6 pages.

(Continued)

*Primary Examiner* — Daniel V Venne
(74) *Attorney, Agent, or Firm* — NIXON & VANDERHYE, PC

(57) ABSTRACT

The invention relates to a system (1, 2) (1, 4) for handling marine (3) or underwater (5) drones, the system (1, 2) (1, 4) comprising a drone interface module (2, 4) and a floating pontoon (1) with two hulls (11) and an arch (10), the pontoon (1) is catamaran-shaped and delimits a downflooded reception space (17), the arch (10) comprises at least one device (12) for attachment to a winch cable, the pontoon (1) comprises devices (13) for detachable attachment to a drone interface module (2, 4) detachably and interchangeably installed in the receiving space (17), the drone interface modules (2, 4) forming an at least partially flooded docking area (23, 42) for the drone (3, 5), the drone interface modules (Continued)

(2, 4) have a lower portion (22, 43) configured to rest stably on a flat surface after the drone interface module (2, 4) has been removed from the pontoon (1).

20 Claims, 8 Drawing Sheets

(58) Field of Classification Search
USPC ..... 114/44
See application file for complete search history.

(56) References Cited

U.S. PATENT DOCUMENTS 5,995,882 A * 11/1999 Patterson ..... B63B 27/36 701/532
6,390,012 B1 * 5/2002 Watt ..... B63B 27/36 114/51
6,480,188 B1 * 11/2002 Horsley ..... G06F 3/0362 345/184
6,840,188 B1 1/2005 Witbeck
8,590,476 B2 * 11/2013 Goudeau ..... B63B 27/16 114/51
10,556,644 B2 * 2/2020 Kim ..... B63B 21/16
11,485,461 B2 * 11/2022 Latham ..... B63C 7/24
12,012,191 B2 * 6/2024 Cadalen ..... B63B 21/66
2009/0308299 A1 * 12/2009 Luccioni ..... B63G 8/001 114/230.1
2010/0018449 A1 * 1/2010 Luccioni ..... B63B 27/36 114/322

OTHER PUBLICATIONS

Written Opinion of the ISA for PCT/EP2021/056321 dated Jun. 23, 2021, 7 pages.

* cited by examiner

SYSTEM FOR HANDLING MARINE OR UNDERWATER DRONES BY FLOATING PONTOON WITH REMOVABLE DRONE INTERFACE MODULE, ADAPTED SHIP

CROSS-REFERENCE TO RELATED APPLICATIONS

This application is the U.S. national phase of International Application No. PCT/EP2021/056321 filed Mar. 12, 2021 which designated the U.S. and claims priority to FR Patent Application No. 2002568 filed Mar. 16, 2020, the entire contents of each of which are hereby incorporated by reference.

TECHNICAL FIELD

The present invention generally relates to the field of shipbuilding. It more particularly relates to a system for handling marine or underwater drones via a floating pontoon comprising a removable drone interface module. It also relates to a ship suitable for implementing the system.

TECHNOLOGICAL BACKGROUND

Ships suitable for launching and recovery drones at sea are known. Document FR17 60492, which describes a ship of this type, can be mentioned. However, this type of ship is specialized and is not suitable for effective launch or recovery of a drone of a type different than that for which it is specialized.

Indeed, launch and recovery of marine or underwater drones are made on the open sea, with sea and weather conditions liable to be dangerous and challenging. It would therefore be useful for the personnel to be exposed to the elements for as little time as possible or not at all, and to avoid the risk of them falling overboard during operations of preparation, installation, craning . . . , more generally handling, of a drone. Also known are the documents KR 102 034 174 B1, WO 2019/231324 A1 and U.S. Pat. No. 6,840,188 B1.

DISCLOSURE OF THE INVENTION

To solve this problem and others that will appear on reading the patent application, it is proposed a system in which each type of drone is installed in a drone interface module specific to the drone and this module is adapted to be handled simply by a pontoon that may be lowered down for launching to water and raised up, out of water, onto the ship, still simply.

More precisely, it is proposed according to the invention a system for handling marine or underwater drones for the launching or recovery of said marine or underwater drones, wherein the system is able to float on water and includes a drone interface module and a floating pontoon, wherein the pontoon is consisted, in lower portion, of two shells, and in upper part, of an arch bridging the two shells, each shell including towards the bottom a hull topped with an out-of-water area, the arch being secured to the out-of-water area of the two shells, wherein the pontoon is a catamaran-shaped structure longitudinally elongated between a front end and a rear end, the two shells being longitudinally elongated and parallel to each other, delimiting between them and with the arch located above a reception space that is open on the front and on the rear, said reception space being longitudinally elongated and submerged towards the bottom, each shell having an inner face located on the side of the reception space, an outer face, an upper face, a lower edge, a front end and a rear end, the pontoon being symmetric with respect to a sagittal plane, and wherein the arch includes at least one attachment device for attachment to a winch cable for raising up the pontoon out of water or, conversely, lowering down the pontoon for launching, wherein the pontoon includes devices for removable fastening to a drone interface module installed in a removable and interchangeable manner in the reception space, the drone interface modules being open for the passage of a drone at least at one of their two ends and being hollow and forming a longitudinally extended and at least partially submerged docking area for a drone, wherein a marine drone floating at the surface or an underwater drone diving near the surface can enter the docking area of the drone interface module installed in the reception space, or, conversely, exit therefrom when the pontoon and its drone interface module are at water and wherein the drone interface modules have a lower portion and are configured to rest stably with their lower portion on a flat surface once the drone interface module disassembled from the pontoon.

Other non-limiting and advantageous features of the system according to the invention, taken individually or according to all the technically possible combinations, are the following:

- the drone interface modules have two ends, a rear end, and a front end,
- the drone interface modules are open for passage of a drone at least at the rear end,
- the flat surface is substantially horizontal,
- the flat surface is a ship deck,
- the flat surface is a dock, floating or not,
- the drone interface module is inserted into or disassembled from the pontoon through the bottom of the reception space,
- the drone interface module is inserted into or disassembled from the pontoon through the front of the reception space,
- the drone interface module is inserted into or disassembled from the pontoon through the rear of the reception space,
- the term "open" or "closed" for the drone interface modules relates to the possibility or not for a drone to pass, wherein a closed side of the drone interface module can be continuous or discontinuous/openwork,
- the walls of the drone interface module are continuous, in particular made of metal or composite sheets,
- the walls of the drone interface module are discontinuous, in particular made of an assembly of metal or composite profiles or rods,
- at least one of the drone interface modules is further open towards the front,
- at least one of the drone interface modules is further open towards the top and closed towards the bottom,
- preferably, at least one of the drone interface modules is open towards the rear, towards the front and towards the top and closed towards the bottom, said drone interface module forming a docking area of U-shaped cross-section,
- at least one of the drone interface modules is further open towards the bottom and closed towards the top,
- at least one of the drone interface modules is closed towards the bottom and towards the top,
- preferably, at least one of the drone interface modules is open towards the rear and closed towards bottom, towards the top and towards the front, said drone interface module forming a tubular docking area, the tubular drone interface module open towards the rear and closed bottom, towards the top and towards the front, is a cage, the total waterline area, Sfl, for both shells of the pontoon, in $m^2$, is equal to or lower than four times the square root of the submerged volume in $m^3$, Vim, i.e.: $Sfl=<4*\sqrt{Vim}$, when the system consisted of the pontoon with its drone interface module, with or without a drone in the docking area of the drone interface module, floats freely, the out-of-water area is above the waterline, the system is consisted of the pontoon and the drone interface module, the drone does not belong to the system, the system includes a pontoon and several types of drone interface modules interchangeable as a function of the drone to be handled, the system includes several types of pontoons and several types of drone interface modules interchangeable as a function of the drone to be handled, the pontoon has a pontoon gravity centre, the drone interface module has a module gravity centre, the drone has a drone gravity centre, and the pontoon, drone and drone interface module gravity centres are longitudinally aligned and are, preferably, located in the sagittal plane of the pontoon, the two keels of the pontoon are further secured to each other by a bottom wall extending under the surface of water between the two keels and closing the reception space at least in part towards the bottom, the pontoon without drone interface module and without drone is configured to float at the surface of water in a stable manner, that is to say without capsizing, the pontoon without drone interface module and without drone is configured to automatically self-right in case of capsizing, the pontoon with a drone interface module and without a drone in the module is configured to float at the surface of water in a stable manner, that is to say without capsizing, the pontoon with a drone interface module and without a drone in the module is configured to automatically self-right in case of capsizing, the pontoon with a drone interface module and with a drone in the module is configured to float at the surface of water in a stable manner, that is to say without capsizing, the pontoon with a drone interface module and with a drone in the module is configured to automatically self-right in case of capsizing, in the pontoon, the arch is secured to the two shells in a non-removable manner, in the pontoon, the arch is secured to the two shells in a removable manner, the arch forms a vault elongated above the drone reception space, the removable fastening devices of the pontoon are pinned or bolted, the pontoon including rings coming opposite rings of the drone interface module and through which rings pins or bolts are inserted, the removable fastening devices of the pontoon are camlocked, the removable fastening devices are at least two in number per shell with at least one fastening towards the front and one fastening towards the rear, the arch further includes at least one device for attachment to a towing cable, the device for attachment to a winch cable and the device for attachment to a towing cable are a single and same common cable attachment device, the front end of each shell has the shape of a wave piercer, the inner face of each shell is flat, the two inner faces of the two shells are parallel to each other, the two inner faces of the two shells are vertical, the lower edges of the two shells of the pontoon are substantially horizontal over at least part of their length, said horizontal portion being intended to lay on a plane once the pontoon is out of water, lower portions of the drone interface module installed in the pontoon are substantially in the plane of the horizontal portions of the lower edges of the two shells of the pontoon, the horizontal portions of the lower edges of the two shells of the pontoon, and the lower portions of the drone interface modules installed being intended to lay on a plane once the system out of water, the lower portions of the drone interface module have feet or fins, the lower portions of the drone interface module form a horizontal plane that is continuous (e.g. a sheet plate) or open work (e.g. profiles), the shells comprise ballasting means for adjusting the buoyancy of the pontoon and hence the height of the hull, the lower edge of each shell includes at least one flat portion intended to be put on a flat surface once the pontoon is out of water, the lower edges of the shells comprise an elastomeric layer or elastomeric pads in the horizontal portions of the lower edges intended to be laid on a flat surface once the pontoon is out of water, each shell has a flat upper face and the arch is secured to the upper face of the shell towards the inner edge of said upper face, that is to say on the side of the reception space, in order to form on the upper face of the shell and laterally to the arch a circulation area for a human operator, the arch comprises at least one sagittal groove in which can circulate a wheelhouse of a drone with a wheelhouse, in the case of a drone interface module closed towards the top, the top comprises at least one sagittal groove in which can circulate a wheelhouse of a drone with a wheelhouse, in the case of a pontoon with a bottom wall, the bottom wall comprises at least one sagittal groove in which can circulate a keel of a drone with a keel, in the case of a drone interface module closed towards the bottom, said bottom comprises at least one sagittal groove in which can circulate a keel of a drone with a keel, the sagittal groove(s) of the arch, and/or of the drone interface module, are on the rear of the system, the sagittal groove(s) of the arch, and/or of the drone interface module, are on the front of the system, the system comprises sagittal grooves of the arch and/or of the drone interface module on the front and on the rear of the system, the system with a pontoon and a drone interface module is structurally symmetric with respect to a median transverse vertical plane, the system with a pontoon and a drone interface module is structurally asymmetric with respect to a median transverse vertical plane, the system with a pontoon and a drone interface module is functionally asymmetric with respect to a median transverse vertical plane, and the drone in water can enter or exit only through one end, front or rear, of the system in water, the system with a pontoon and a drone interface module is functionally symmetric with respect to a median transverse vertical plane, and the drone in water can enter the system in water or exit therefrom, through the front end or through the rear end, the pontoon is structurally symmetric with respect to a median transverse vertical plane, the pontoon is structurally asymmetric with respect to a median transverse vertical plane, the pontoon is functionally asymmetric with respect to a median transverse vertical plane, and the drone in water can enter or exit only through one end, front or rear, of the system in water, the pontoon is functionally symmetric with respect to a median transverse vertical plane, and the drone in water can enter the system in water or exit therefrom, through the front end or through the rear end, the drone interface module is structurally symmetric with respect to a median transverse vertical plane, the drone interface module is structurally asymmetric with respect to a median transverse vertical plane, the drone interface module is functionally asymmetric with respect to a median transverse vertical plane, and the drone in water can enter or exit only through one end, front or rear, of the system in water, the drone interface module is functionally symmetric with respect to a median transverse vertical plane, and the drone in water can enter the system in water or exit therefrom, through the front end or through the rear end, each shell comprises, on its inner face located on the side of the reception space, at least one guiding rail for the drone interface module, the guiding rails are arranged by pair of two rails of parallel paths and opposite to each other on the two inner faces of the two shells, the path of the guiding rail is straight, the path of the guiding rail is substantially vertical, the path of the guiding rail comprises a section that is inclined with respect to the rest of the path, the rail is a hollow or protruding rail, the drone interface module comprises devices intended to slide or roll on or in the guiding rails, the sliding or rolling devices and the guiding rails are inverted between the pontoon and the drone interface module, the drone interface module comprises, in its docking area, at least one drone guiding and retaining profile, the drone comprises devices intended to slide or roll on or in the drone interface module guiding and retaining profiles, the sliding or rolling devices of the drone are arranged at the end of ailerons of the drone, by construction/structurally, the drone interface modules are laterally closed, one of the drone interface modules of the system is open towards the rear, towards the front and towards the top and closed towards the bottom, said drone interface module forming a docking area of U-shaped cross-section, one of the drone interface modules of the system is open towards the rear and is closed towards the bottom, towards the top and towards the front, said drone interface module being a longitudinally elongated cage able to be inserted into the reception space of the pontoon, said cage being consisted of an assembly of metal rods delimiting a substantially tubular inner housing forming the docking area and in which inner housing an underwater drone can be inserted and retained, said cage comprising a stowing shield arranged on the rear of the cage in the absence of drone in the cage, the stowing shield being able to slide in the inner housing from the rear to the front, and conversely, the front of the drone being able to be removably secured to the stowing shield, the drone secured to the stowing shield and said stowing shield moving together within the inner housing, the movements of the stowing shield are passive, one or several propulsion means of the underwater drone causing the underwater drone and the stowing shield to move together, the movements of the stowing shield are active, one or several operating means of the stowing shield causing the underwater drone and the stowing shield to move together, the stowing shield and the front of the underwater drone comprise complementary removable connection means for at least electrical connections, the hulls of the two shells of the pontoon comprise orientable bearing planes, the system is intended to be transported on a ship, the ship comprising a crane for lowering the system down to sea and raising it up aboard the ship, the system is intended to be transported on a ship, the ship comprising a davit for lowering the system down to sea and raising it up aboard the ship, the system is intended to be transported on a ship, the ship comprising a gantry crane ("A frame") for lowering the system down to sea and raising the system up aboard the ship, the ship comprises several systems, the ship comprises a set of pontoons, the ship comprises a set of drone interface modules, the ship comprises a set of drones, the drones are stored in drone interface modules and said modules with their drones are stored in the ship independently of the pontoon, the drones are stored in drone interface modules and said modules with their drones are stored in pontoons, the ship comprises a pontoon and a set of drones stored in drone interface modules, the orientable bearing planes make it possible to adjust the position of the system when the latter is towed along an edge of the ship, the orientable flaps make it possible to adjust the position of the system when the latter is towed behind the ship, the adjustable flaps are active and are servo-controlled or not, the adjustable flaps are passive and can be preadjusted by adjustment in desired orientations, the pontoon comprises an electric or pneumatic circuit for controlling actuators, the drone interface module comprises an electric or pneumatic circuit for controlling actuators, the pontoon further comprises a winch, the winch is a towing cable winch, said towing cable comprising a device for removable attachment to the drone and allowing a drone attached to the attachment device to be towed towards and into the docking area of the drone interface module, the drone interface module further comprises a winch, the device for removable attachment to the drone is further configured to operate a movable keel of a drone with a movable keel.

The invention also relates to a ship comprising at least one system according to the invention and at least one drone, the ship further comprising a crane and/or a davit and/or a gantry crane, for lowering the system down to sea and raising the system up aboard the ship.

Other non-limiting and advantageous features of the ship according to the invention, taken individually or according to all the technically possible combinations, are the following:

the ship comprises at least one storage place dedicated to the storage of a system with or without a drone, the ship comprises at least one storage place dedicated to the storage of a drone interface module, individually/alone, with or without a drone in its docking area, the ship comprises at least one storage place dedicated to the storage of a pontoon, individually/alone, the lowering down to sea, or the raising up aboard the ship, of the system may relate to a system, that is to say a pontoon and the drone interface module, with or without a drone.

DETAILED DESCRIPTION OF AN EXEMPLARY EMBODIMENT

The following description in relation to the appended drawings, given by way of non-limiting examples, will allow a good understanding of what the invention consists of and of how it can be implemented.

Figure 1:
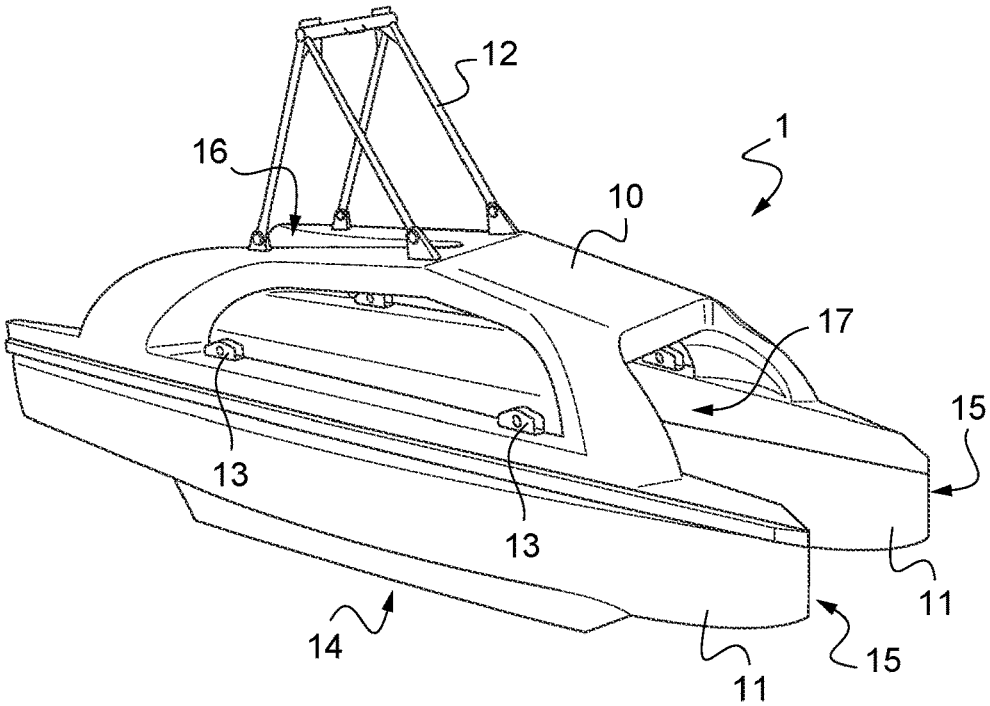
FIG. 1 is a front lateral perspective view of an example of pontoon according to the invention.

FIG. 1 shows a pontoon 1 alone. Pontoon 1 can float on water once launched to water. Pontoon 1 is similar to a catamaran and it has two shells 11 parallel to each other and linked to each other, on the top, by an out-of-water arch 10, that forms a vault above a reception space 17 delimited between the two shells 11. The pontoon 1 is longitudinally elongated between the front and the rear and is symmetric with respect to a sagittal plane or, which is equivalent, to a median vertical antero-posterior plane, separating the pontoon into two symmetric lateral portions. The reception space 17 is open towards the front and towards the rear of the pontoon. The front of the pontoon 1 corresponds to the tapered front ends 15 of the two shells, the rear of the two shells being wider, the pontoon of the example being not structurally symmetric with respect to a median vertical transverse plane.

The reception space 17 is in this example open towards the bottom but, in other embodiments of the pontoon, a submerged/underwater bottom wall can link the two shells 11 towards the bottom and close the reception space at least in part towards the bottom.

Figure 11:
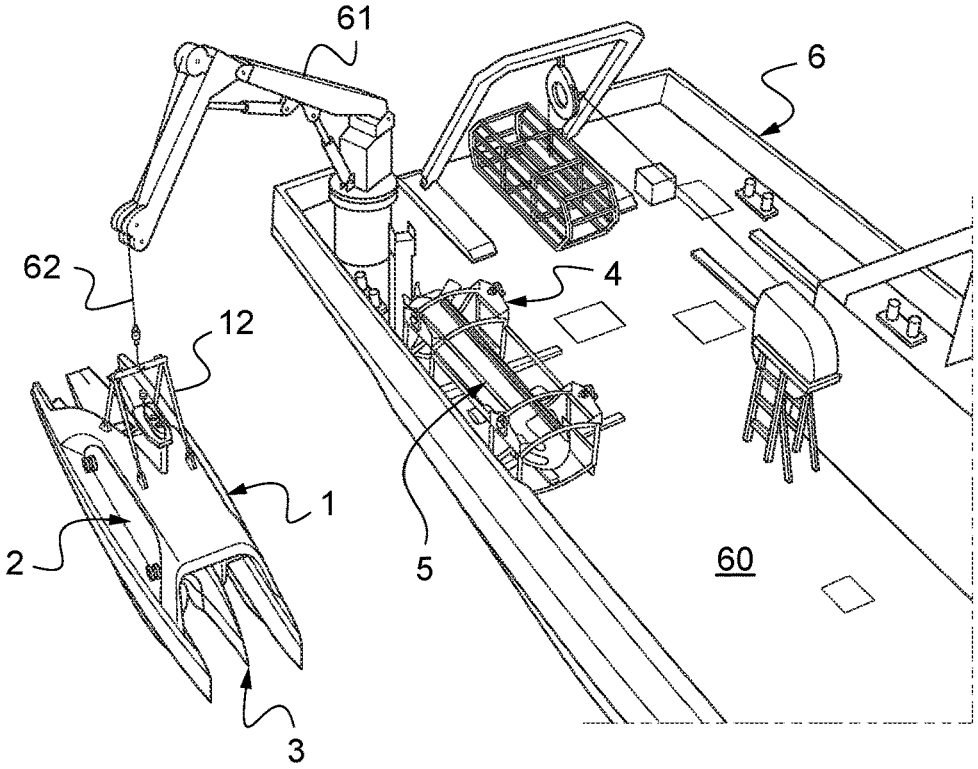
FIG. 11 is a perspective view of a ship having launched to water the pontoon with a drone interface module and a marine drone of FIG. 4 or 5 for launching the marine drone, the drone interface module with an underwater drone of FIG. 8 being meanwhile stored on the deck of the ship.

The arch 10 comprises an attachment device 12 intended to allow attachment to a winch cable 62 for raising up the pontoon out of water or, conversely, to lower down the pontoon for launching it to water from a ship 6 equipped with a crane 61 (FIG. 11). The pontoon 1 alone or with a drone interface module 2, 4 with or without a drone 3, 5, floats once launched to water and is relatively stable thanks to the shape of the two shells 11. The shells of the pontoon are designed in such a way to have a very small waterline area. The submerged volume is privileged in depth rather than in width and, that way, the sensitivity to waves is considerably reduced, the sinking variation causing a small variation in submerged volume.

Moreover, the pontoon 1 with a drone interface module 2 and a drone 3, 5, does not need to have increased buoyancy with respect to that which allows it to float alone, without the drone interface module and without a drone, because, on the one hand, the weight of the drone interface module is far lower than the weight of the pontoon alone and, on the other hand, when the pontoon is on water, the drone that is in the reception space floats by itself in the case of a marine drone or is in hydrostatic equilibrium in the case of an underwater drone, as the drone does not add weight to the pontoon.

In order to increase the stability of the system, at the time of design of the pontoons, drone interface modules and drones, the respective longitudinal positions of these elements within the system with its drone are adapted. In particular, these elements are configured in such a way that the pontoon, drone and drone interface module gravity centres are longitudinally aligned and are located in the sagittal plane of the pontoon and the closest possible to each other. Ballasts can be used within these elements to modify the position of the gravity centre of these elements. The advantage of using ballasts is that it is possible to adjust the position of the gravity centre after the design and, in particular, during operation on site.

The shells 11 are longitudinally elongated and relatively narrow. Each shell 11 has an inner face located on the side of the reception space 17, an outer or lateral face of the pontoon, an upper face being connected to the arch 10, a lower edge, a front end 15 and a rear end. The inner face of the shell 11 is flat, preferably vertical. The external face of the shell 11 is substantially convex towards the outside and the shell is wholly wider towards its apex, where it is out of water, than towards its lower end, where it is submerged and forms the hull of the shell 11. The lower edge of each shell 11 comprises a flat portion 14 intended to be put on a plane, in particular a ship deck 60 or a dock, once the pontoon 1 out of water.

The pontoon 1 can be made by assembly of metal panels and/or moulded or fabricated parts made of glass or carbon fibre composite, for example. The pontoon 1 can also be made by complete moulding of glass or carbon fibre, for example.

Figure 4:
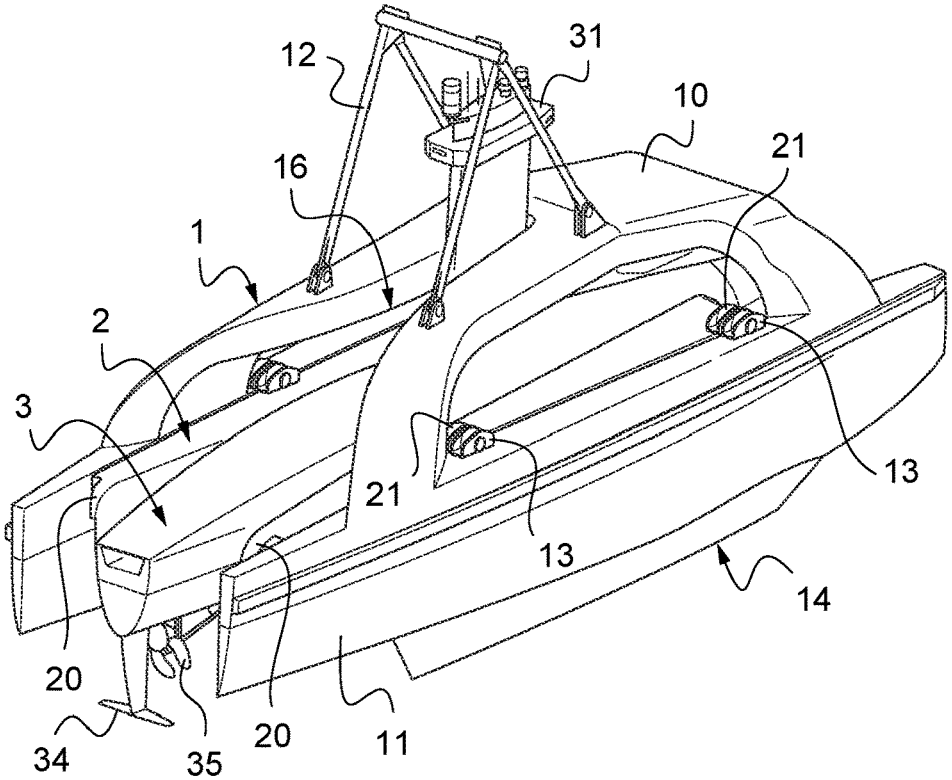
FIG. 4 is a rear lateral perspective view of the pontoon of FIG. 1 with, installed in the reception space, the drone interface module and its marine drone of FIG. 3.

The arch 10 of the pontoon 1 comprises towards the rear of the pontoon, a sagittal groove 16 for the passage and insertion of a wheelhouse 31 (FIG. 4) of a drone 3 with a wheelhouse 31 when said drone 3 docks into the drone interface module 2 installed in the pontoon (FIG. 4). The pontoon comprises devices 13 for attachment to a drone interface module 2, 4. These attachment devices 13 are here of the ring type and use bolts or pins to removably fasten/secure a drone interface module 2, 4 in the reception space 17 of the pontoon 1.

Figure 2:
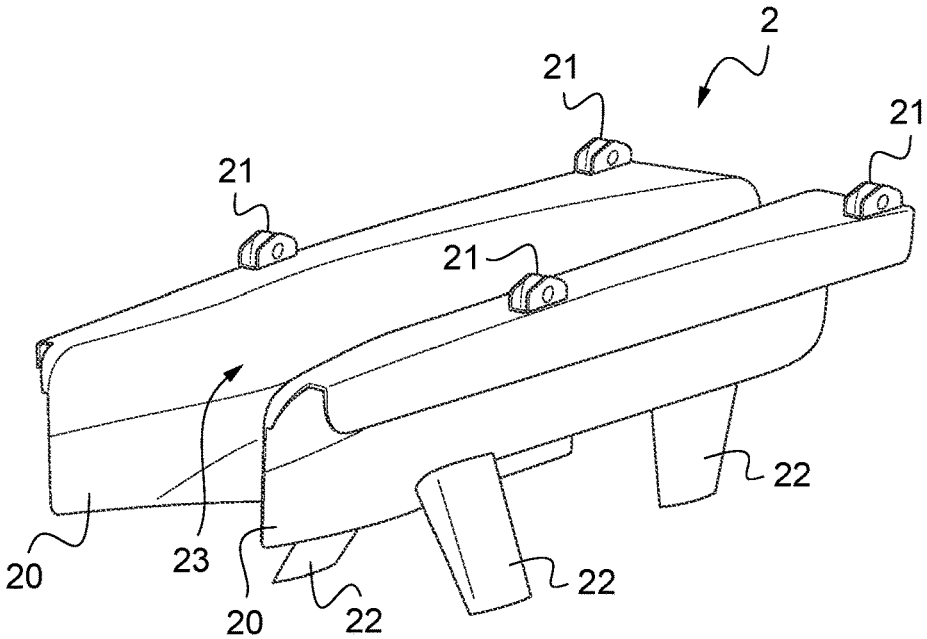
FIG. 2 is a rear lateral perspective view of a first example of drone interface module according to the invention.

The drone interface module 2 of FIG. 2 is adapted to a marine drone 3 floating at the surface and having a keel 32. The keel 32 can, as here, be ended at the bottom by a bulb 33. The marine drone 3 further comprises a wheelhouse 31. The drone interface module 2 is longitudinally elongated and forms a cradle that has, in cross section, a U-shape with a continuous bottom in the front part of said cradle, the rear part having an open bottom for the passage of the keel 32 of the marine drone 2 when the marine drone 2 is installed in the docking area 23.

The drone interface module 2 may essentially consist of a contoured sheet that can be made by assembly of metal panels and/or moulded or fabricated panels made of glass or carbon fibre composite, for example. The drone interface module 2 can also be made by complete moulding of glass or carbon fibre, for example.

Like the pontoon 1, the drone interface module 2 is intended to be laid flat on a plane, in particular a ship deck 60 or a dock, whether individually/alone, with or without a drone, or installed in the pontoon 1. For that purpose, the drone interface module 2 comprises fins 22, a sagittal one on the front and two lateral ones, inclined and on the rear, the fins 22 forming together a tripod. These fins 22 are ended at the bottom in a same plane.

The drone interface module 2 has an inner shape adapted to the shape of the drone 3 that must be received. This inner shape to which the drone docks correspond to the docking area 23 of the drone interface module. The drone interface module 2 is also adapted to the shape of the reception space 17 of the pontoon 1 where it has to be installed. The drone interface module 2 comprises rings 21 intended to come into correspondence with those of the attachment devices 13 of the pontoon 1 when the drone interface module 2 is installed in the reception space 17 of the pontoon 1. Bolts or pins are passed through the rings of the pontoon and of the drone interface module so as to removably fasten the two together.

Figure 3:
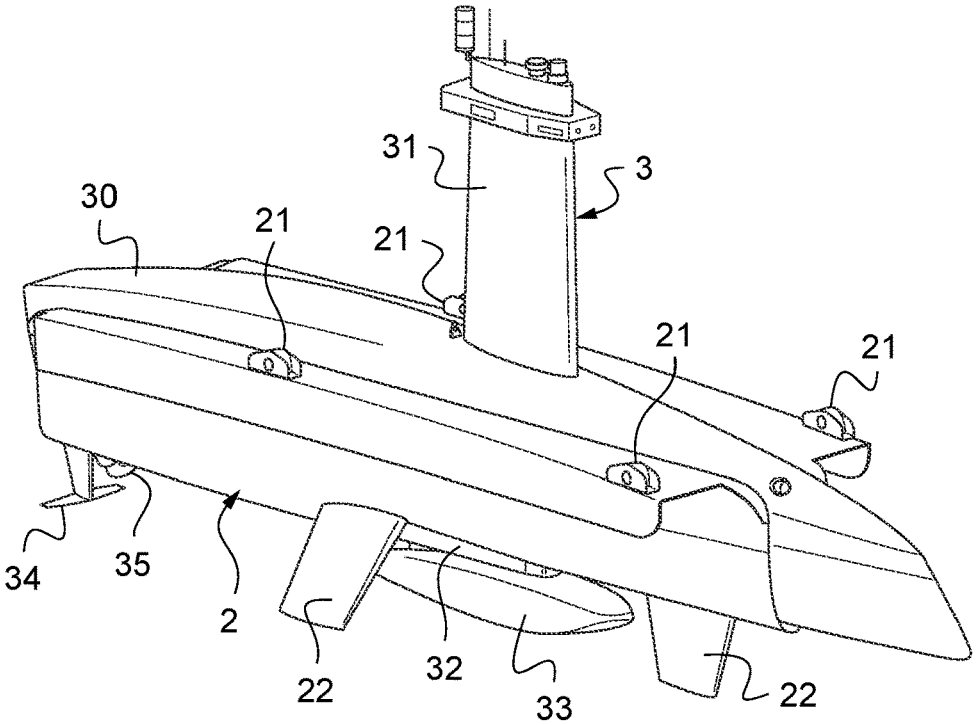
FIG. 3 is a front lateral perspective view of the drone interface module of FIG. 2 including, in its docking area, a marine drone with a keel and a wheelhouse.

In FIG. 3, a marine drone 3 is in the docking area 23 of the drone interface module 2. This marine drone 3 comprises a shell 30 on which a wheelhouse 31 is erected and under which the keel 32 and the bulb 33 thereof are inserted. Preferably, the marine drone 3 is a marine drone with a raisable keel comprising an internal keel raising system, the keel 32 being able to be raised up and lowered down. The marine drone comprises a propeller propulsion means 35 and orientation and stabilization means 34.

In FIG. 4, the drone interface module 2 with the marine drone 3 installed in the docking area 23 has been secured in the reception space 17 of the pontoon 1. The lower portion of the drone interface module 2 is submerged when the system is in water. The marine drone 2 enters and exits from the docking area 23 by floating through the rear of the drone interface module 2 and hence the rear of the pontoon 1.

Figure 5:
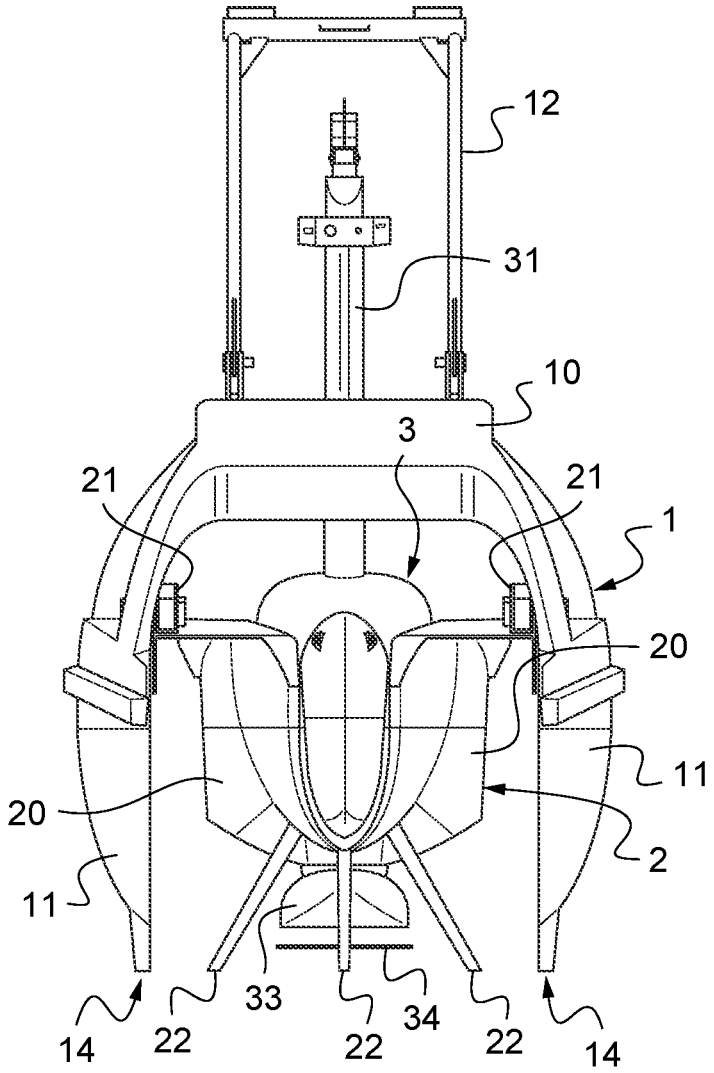
FIG. 5 is a front view of the pontoon with a drone interface module and a marine drone of FIG. 4.

FIG. 5 allows a better visualization of the relations between the pontoon 1, the drone interface module 2 and the marine drone 3, as well as the corresponding structures. In particular, it can be seen that the lower ends of the fins 22 and the flat portions 14 of the lower edges of the shells 11 are substantially in a same plane, so as to distribute the load when the system is stored out of water on a deck 60 of a ship 6 (FIG. 12) or a dock.

The pontoon 1 with its drone interface module 2, 4 forms the marine or underwater drone handling system and this system allows a simple launching or recovery of the marine or underwater drones. The drone interface modules 2, 4 do not include proper buoyancy means and, if they are launched to water alone/individually, they sink. That is the pontoon that ensures the system buoyancy.

The drone interface modules are specialized, i.e. adapted to the drones they have to receive and store in their docking areas. Therefore, in the reception space of the pontoon is installed the drone interface module that suits the drone launching or recovery operation that is planned. It is provided a single universal pontoon or even a small number of pontoons that are more specialized but capable of receiving several types of drone interface modules, and several types of drone interface modules if several marine and/or underwater drones have to be launched or recovered.

Moreover, the drone interface modules may be stored individually (independently of the pontoon), with or without a drone in their docking area on a ship deck or a dock. For the storage on a ship deck or a dock, means 14, 22, 43 are thus provided, which allow both the pontoon and the drone interface module alone/individually or assembled together (thus forming the drone handling system) to lay on a plane.

Figure 6:
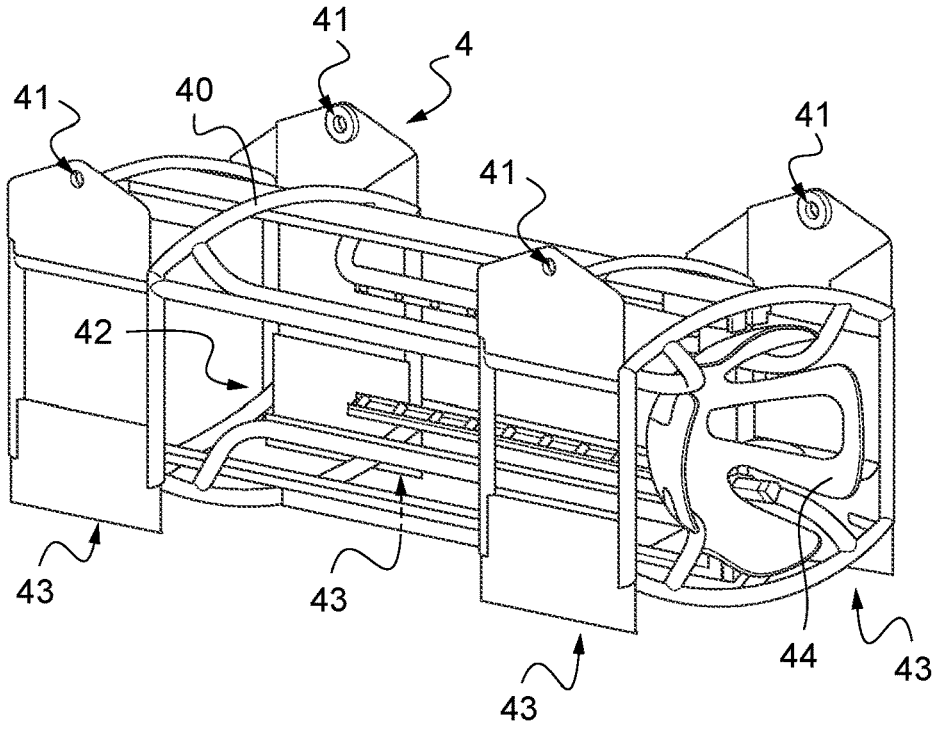
FIG. 6 is a rear lateral perspective view of a second example of drone interface module according to the invention.
Figure 7:
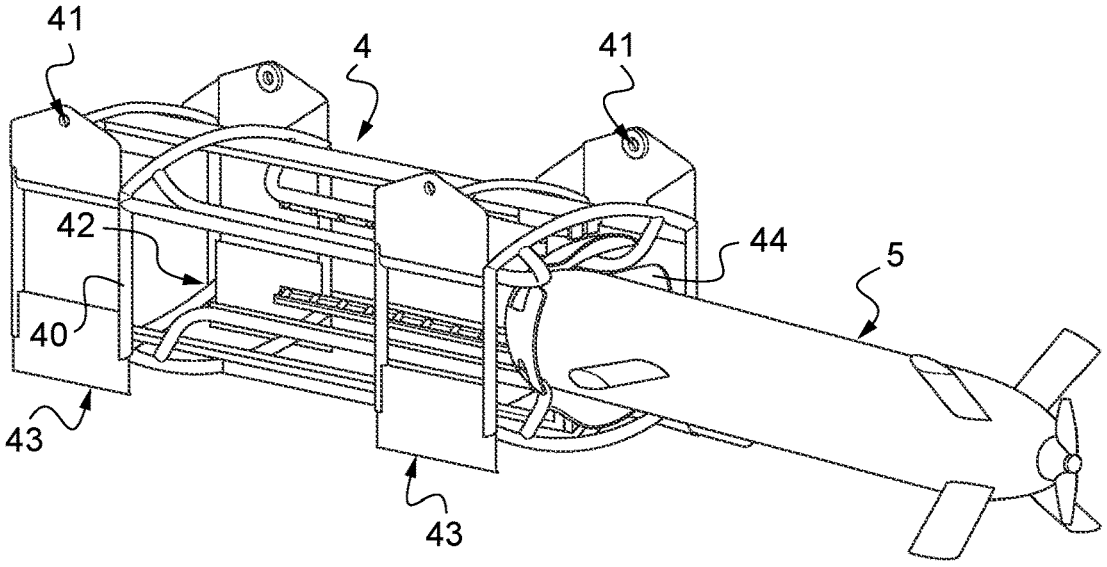
FIG. 7 is a rear lateral perspective view of the second example of drone interface module of FIG. 6 with an underwater drone ready to enter the docking area of said drone interface module.

In FIG. 6, another type of drone interface module 4 is shown, which is this time intended to store in its docking area 42 an underwater drone 5. The drone interface module 4 comprises, as the preceding one, rings 41 intended to come into correspondence with those of the attachment devices 13 of the pontoon 1 when the drone interface module 4 is installed in the reception space 17 of the pontoon 1. This drone interface module 4 consists of an assembly of metal profiles or rods and forms a cage 40 inside which is located the docking area 42. As for the preceding one, the drone interface module 4 comprises means allowing it to rest on a plane, in particular a deck 60 of a ship 6 or a dock, and which are here feet 43. The rear of the drone interface module 4 comprises a stowing shield 44 on which the underwater drone 5 can be removably secured as can be seen in FIG. 7.

This stowing shield 44 is able to slide inside the drone interface module 4 to give the underwater drone 5 access to the docking area 42.

Figure 13:
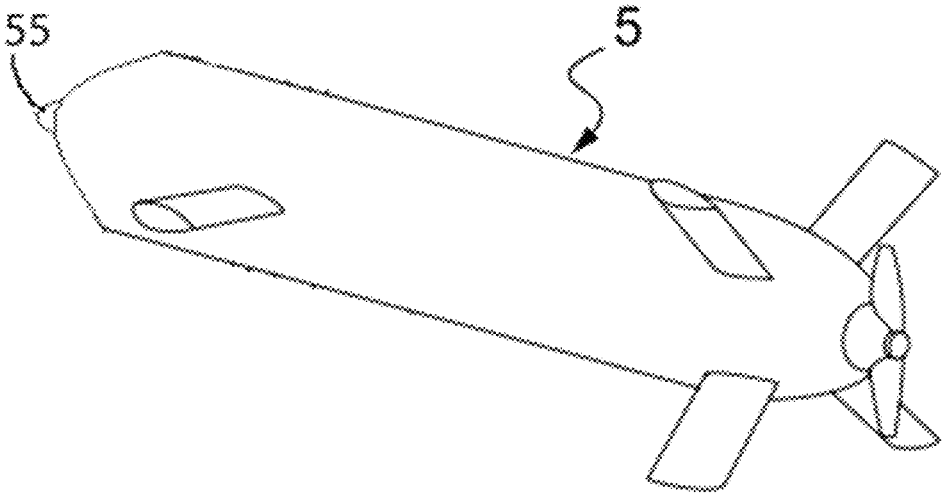
FIG. 13 is a perspective view of an example of an underwater drone.

The stowing shield 44 and the front of the underwater drone 5 comprise complementary removable connection devices for at least electrical connections. The complementary removable connection device 45 of the stowing shield 44 is visible in FIG. 10. The complementary removable connection device 55 of the underwater drone 5 is visible in FIG. 13.

Figure 8:
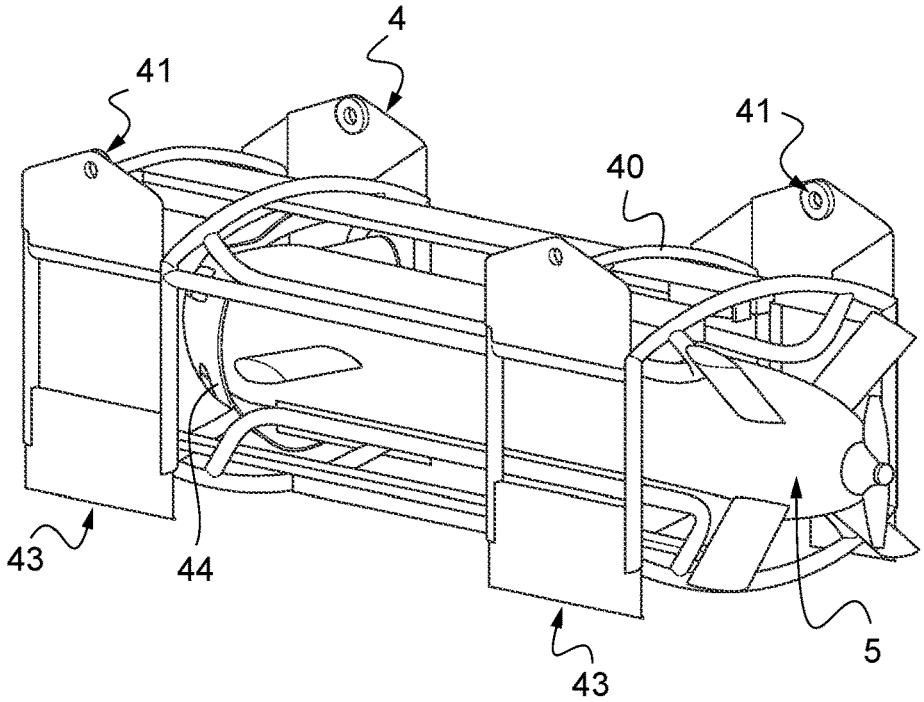
FIG. 8 is a rear lateral perspective view of the second example of drone interface module of FIG. 6 with an underwater drone entered and stored in the docking area of said drone interface module.

In FIG. 8, the stowing shield is offset towards the front of the cage 40 and the underwater drone is now stored in the docking area 42.

Figure 9:
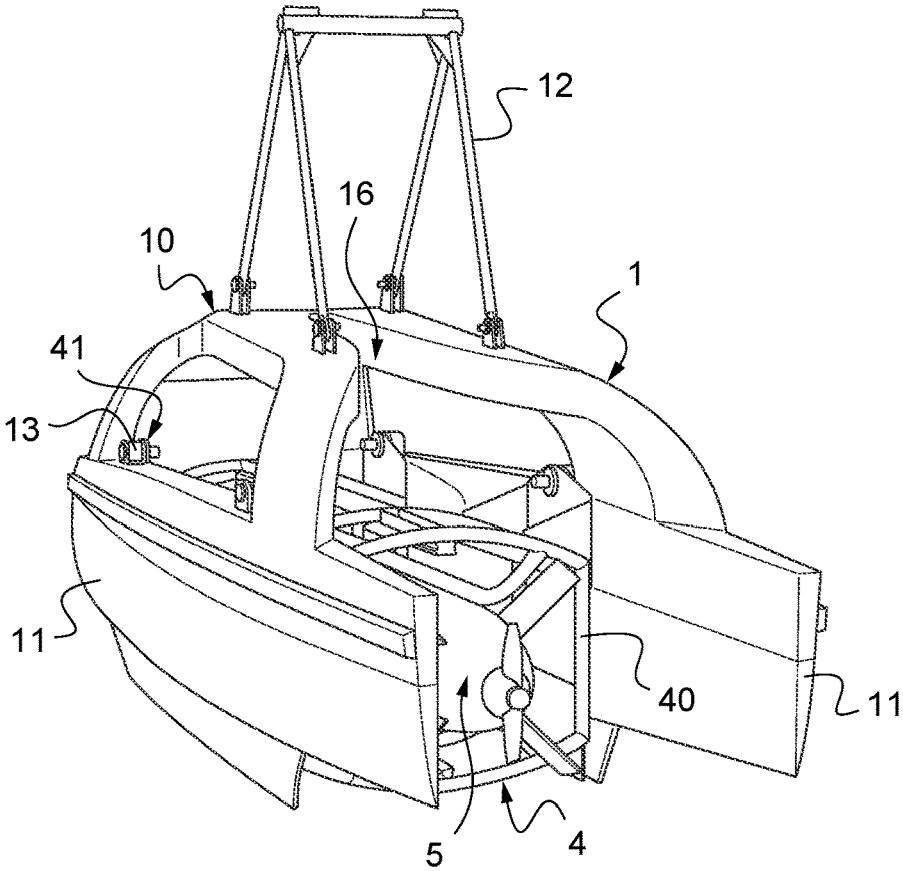
FIG. 9 is a rear lateral perspective view of a pontoon in which is installed the drone interface module and its underwater drone of FIG. 8.
Figure 10:
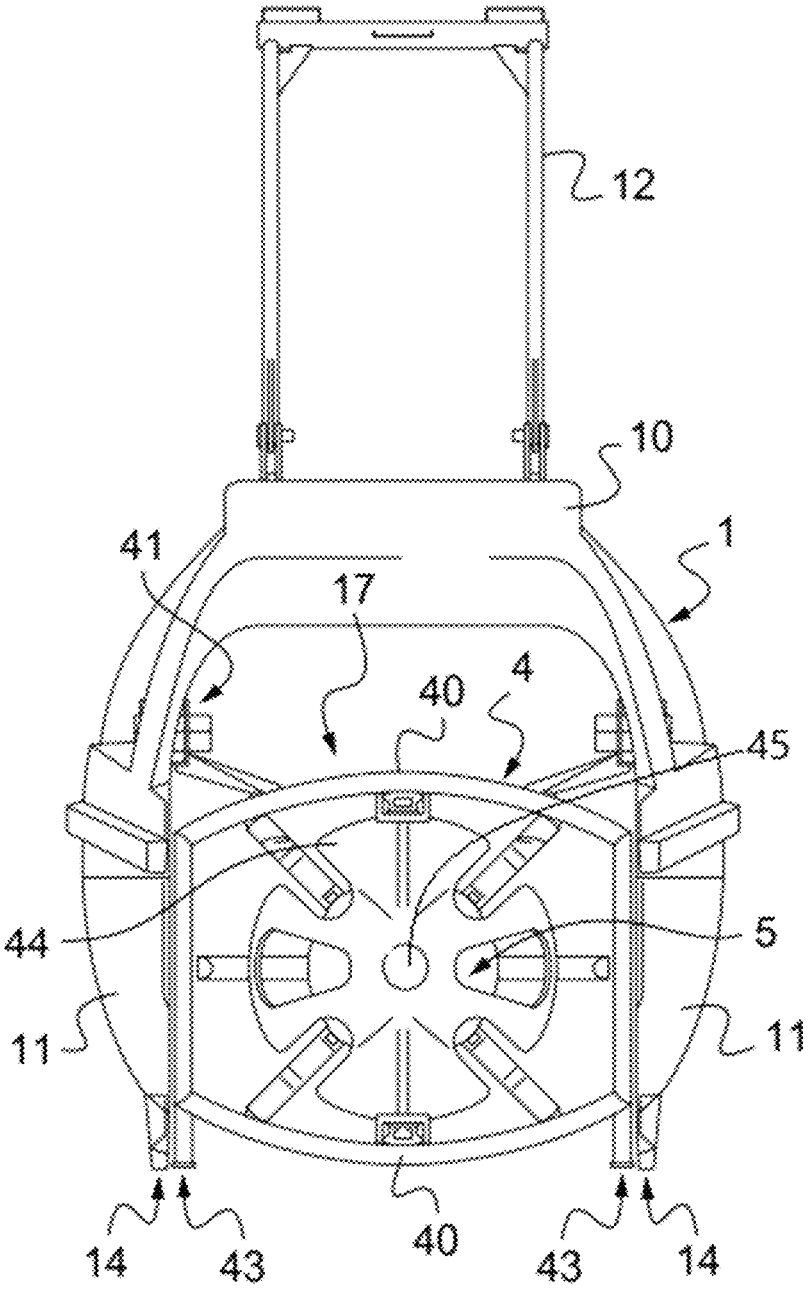
FIG. 10 is a front view of the pontoon with the drone interface module and its underwater drone of FIG. 9.

FIGS. 9 and 10 allow a better visualization within the system of the relations between the pontoon 1, the drone interface module 4 and the underwater drone 5 contained in the module 4.

In order to be able to lay flat the system of FIGS. 9 and 10, the flat portions 14 of the lower edges of the shells 11 and the feet 43 are substantially in a same plane, so as to distribute the load when the system is stored out of water on a deck 60 of a ship 6 (FIG. 12) or a dock.

It is understood that the cage 40 forming the drone interface module 4, once installed in the reception space 17 of the pontoon 1 is totally submerged when the system is on water, and preferably the cage 40 is configured for that purpose if the pontoon buoyancy remains constant. In an alternative embodiment, different pontoons are provided for marine drones and for underwater drones, the buoyancy for these latter being lower for them to sink deeper in water. In another alternative embodiment, it is provided a single type of pontoon but comprising in the shells ballasts that can be filled with water or drained in order to adjust the buoyancy as a function of the type of drone, marine or underwater, that the system has to handle. In still another alternative embodiment, the drone interface module installed in the reception space of the pontoon can slide vertically in order to be lowered down and raised up according to a command. It is also contemplated to place attachment devices 13 at different levels of the pontoon 1 and those which are at a suitable height for the planned operation are used.

Preferably, removable holding means are implemented between the drone interface module and the drone it transports or stores in its docking area. These holding means may be inflatable cushions, movable tabs allowing the drone interface module to tighten or clamp the drone to hold it in place in the docking area as long as no launching operation is in progress.

In one embodiment (not shown), the pontoon comprises bearing planes of the little keel or keel type, forming adjustable flaps that allow adjusting the position of the whole when towed along a ship. These flaps may be active (servo-controlled or not) or passive (in this case, they are pre-adjusted at a defined position).

The pontoon and possibly the drone interface modules preferably comprise an electric network and actuators, in particular a winch for towing the drone in order to make it enter the docking area of the drone interface module and/or for raising up the keel of a marine drone with a raisable keel, in the case where the internal raising system of the marine drone with a raisable keel would be defective.

Figure 12:
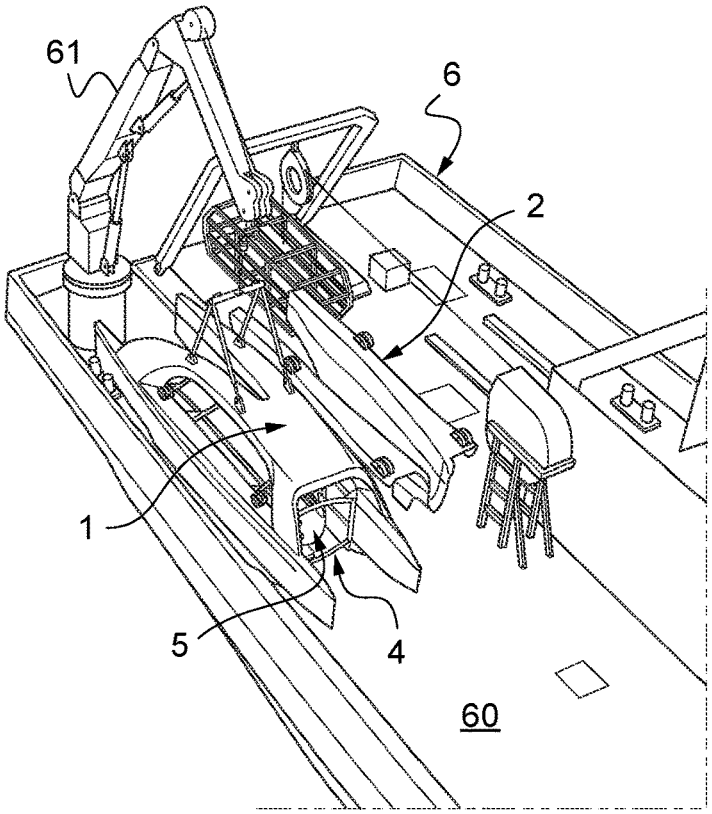
FIG. 12 is a perspective view of a ship after the launching of the marine drone that has moved away and the release and storage of the first example of drone interface module of FIG. 2 on the deck, the pontoon so released from its module having then been attached to the second example of drone interface module with an underwater drone of FIG. 8.

In FIGS. 11 and 12, a ship 6 equipped with a crane 61 can perform drone launching and recovery operations in a simple manner thanks to the system of the invention.

The ship 6 comprises in this example one pontoon 1 and two types of drone interface modules, a module 2 for a marine drone 3 and another module 4 for an underwater drone 5, the drones 3, 5 being stored in the respective docking areas of the two drone interface modules 2, 4. The pontoon, the drone interface module 2 with its marine drone 3, and the drone interface module 4 with its marine drone 5 can be stored on the deck 60 of the ship 6 at three different places. As an alternative, one of the two modules 2, 4 can be pre-installed in the reception space of the pontoon 1 to save space on the deck, two storage places being then sufficient.

In FIG. 11, the ship 6, for launching a marine drone 3, has just launched to water the system 1, 2 consisted of the pontoon 1 and the drone interface module 2, the latter 2 having the marine drone 3 in its docking area 23. The drone interface module 2 will have been previously installed and secured in the reception space 17 of the pontoon 1 with these elements 1, 2 still on the deck 60 of the ship 6. The system 1, 2 has been moved thanks to a winch cable 62 of the crane 61, the winch cable 62 being attached to the attachment device 12 of the arch 10 of the pontoon 1. The ship 6 may be a fixed point or move and, in the latter case, the system 1, 2 or 1, 4 is therefore towed, in this example laterally to the ship 6. Once the system 1, 2 is on water and, given that the lower portion of the docking area is submerged, the marine drone 3 can float and can exit from the system 1, 2 through the rear.

Once the drone 3, 4 released, the system 1, 2 or 1, 4 can be raised for being stored on the deck or the pontoon 1 and the drone interface module 2 or 4 can be separated to use the pontoon 1 for another operation, the drone interface module released/disassembled from the pontoon being stored on the deck. That is what is shown in FIG. 12 in where the drone interface module 2 is stored on the deck and where another type of drone interface module 4, with a cage 40, has been installed in the reception space of the pontoon 1 thanks to the operations of the crane 61. This time, it will hence be possible to later launch to water the underwater drone 5 stored in the docking area of the cage 40 of the system 1, 4.

It is understood that the principle of the invention, which is to implement a standard pontoon in which can be installed an interface module adapted to a particular drone among several types of drone interface modules, wherein these latter are adapted to particular drones, can be implemented with other structures and functional arrangements than those which are exemplified.

For example, it is possible to use a semi-universal drone interface module whose docking area walls can adapt to the drone, the walls being inflatable with water or air. It is possible to make a drone interface module with several distinct docking areas for a same type of drone or drones of different types.

The invention claimed is:

1. A system (1, 2) (1, 4) for handling marine (3) or underwater (5) drones for a launching or recovery of said marine (3) or underwater (5) drones, wherein the system (1, 2) (1, 4) is configured to float on water and includes a floating pontoon (1) and a drone interface module (2, 4) from a number of interchangeable drone interface modules (2, 4), wherein the floating pontoon (1) comprises, in lower portion, of two shells (11), and in upper part, of an arch (10) bridging the two shells (11), each shell (11) including towards bottom a hull topped with an out-of-water area, the arch (10) being secured to the out-of-water area of the two shells (11), wherein the floating pontoon (1) is a catamaran-shaped structure longitudinally elongated between a front end and a rear end, the two shells (11) being longitudinally elongated and parallel to each other, the two shells (11) delimiting in-between and with the arch (10) located above, a reception space (17) that is open on a front end and on a rear end, said reception space (17) being longitudinally elongated and submerged at bottom, each one of the two shells (11) comprising an inner face located on a side of the reception space (17), an outer face, an upper face, a lower edge, a front end (15) and a rear end, the floating pontoon (1) being symmetric with respect to a sagittal plane, and wherein the arch (10) includes at least one attachment device (12) for attachment to a winch cable for raising up the floating pontoon (1) out of water or, conversely, lowering down the floating pontoon (1) for the launching, wherein the floating pontoon (1) includes removable fastening devices (13) for a removably fastening to each one of the number of interchangeable drone interface modules (2, 4) which can be installed in the reception space (17), each one of the number of interchangeable drone interface modules (2, 4) being installable in a removable and interchangeable manner in the reception space (17), the drone interface modules (2, 4) comprising two ends, being hollow and forming a longitudinally extended and at least partially submerged docking area (23, 42) for a drone (3, 5), at least at one of the two ends of the drone interface modules (2, 4) being open for a passage of a drone (3, 5), wherein a marine drone (3) floating at a surface of water or an underwater drone (5) diving near the surface of water can enter the at least partially submerged docking area (23, 42) of an installed drone interface module (2, 4) which is installed in the reception space (17), or, conversely, exit therefrom when the floating pontoon (1) and the installed drone interface module (2, 4) are on water, wherein the drone interface modules (2, 4) each comprises a lower portion (22, 43) and are configured to rest stably with the lower portion (22, 43) on a flat surface once the drone interface module (2, 4) is disassembled from the floating pontoon (1), and wherein one of the number of interchangeable drone interface modules (4) of the system (1, 4) is open towards a rear end and is closed towards bottom, towards top and towards a front end, said one of the number of interchangeable drone interface modules (4) being a longitudinally elongated cage (40) configured to be installed into the reception space (17) of the floating pontoon (1), said cage (40) being an assembly of metal rods delimiting a substantially tubular inner housing forming the at least partially submerged docking area (42) and in which inner housing an underwater drone (5) can be inserted and retained, said cage (40) comprising a stowing shield (44) arranged on a rear end of the cage (40) in absence of an underwater drone (5) in the cage (40), the stowing shield (44) being able to slide in the inner housing from the rear end to a front end and conversely, wherein a front face of the underwater drone (5) is configured to be removably secured to the stowing shield (44), the underwater drone (5) secured to the stowing shield (44) and said stowing shield (44) moving together within the inner housing.

2. The system (1, 2) (1, 4) according to claim 1, wherein the total waterline area (Sfl) of the two shells of the floating pontoon (1), in $m^2$, is equal to or lower than four times the square root of the submerged volume (Vim) in $m^3$ ($Sfl=<4*\sqrt{Vim}$) when the system (1, 2) (1, 4) with the floating pontoon (1) and the installed drone interface module (2, 4), with or without a drone (3, 5) in the at least partially submerged docking area (23, 42) of the installed drone interface module (2, 4), floats freely.

3. The system (1, 2) (1, 4) according to claim 1, wherein the pontoon (1) comprises a pontoon gravity centre, the drone interface module (2, 4) comprises a module gravity centre, the drone (3, 5) comprises a drone gravity centre, and wherein the pontoon, drone and drone interface module (2, 4) gravity centres are longitudinally aligned.

4. The system (1, 2) (1, 4) according to claim 1, wherein the removable fastening devices (13) of the floating pontoon (1) are pinned or bolted, the floating pontoon (1) including pontoon rings coming opposite to module rings (21, 41) of the installed drone interface module (2, 4) and through which pontoon and module rings pins or bolts are inserted.

5. The system (1, 2) (1, 4) according to claim 1, wherein the removable fastening devices (13) of the floating pontoon (1) are cam-locked.

6. The system (1, 2) (1, 4) according to claim 1, wherein the front end (15) of each one of the two shells (11) comprises a shape of a wave piercer, and wherein the inner face of each one of the two shells (11) is flat, the inner faces of the two shells (11) being parallel to each other.

7. The system (1, 2) (1, 4) according to claim 1, wherein the lower edge of each one of the two shells (11) includes at least one flat portion (14) intended to be laid on a flat surface once the floating pontoon (1) is out of water.

8. The system (1, 2) according to claim 1, wherein another one (2) of the number of interchangeable drone interface modules of the system (1, 2) is open towards a rear end, towards a front end and towards top and closed towards bottom, said drone interface module (2) forming a docking area (23) of U-shaped cross-section.

9. The system (1, 2) (1, 4) according to claim 1, wherein hulls of the two shells (11) of the floating pontoon (1) comprise orientable bearing planes.

10. The system (1, 2) (1, 4) according to claim 1, wherein the floating pontoon (1) further comprises a winch.

11. The system (1, 2) (1, 4) according to claim 1, wherein the stowing shield (44) and the front face of the underwater drone (5) comprise complementary removable connection devices for at least electrical connections.

12. The system (1, 2) (1, 4) according to claim 2, wherein the pontoon (1) comprises a pontoon gravity centre, the drone interface module (2, 4) comprises a module gravity centre, the drone (3, 5) comprises a drone gravity centre, and wherein the pontoon, drone and drone interface module (2, 4) gravity centres are longitudinally aligned.

13. The system (1, 2) (1, 4) according to claim 2, wherein the removable fastening devices (13) of the floating pontoon (1) are pinned or bolted, the floating pontoon (1) including pontoon rings coming opposite to module rings (21, 41) of the installed drone interface module (2, 4) and through which pontoon and module rings pins or bolts are inserted.

14. The system (1, 2) (1, 4) according to claim 2, wherein the removable fastening devices (13) of the floating pontoon (1) are cam-locked.

15. The system (1, 2) (1, 4) according to claim 2, wherein the front end (15) of each one of the two shells (11) comprises a shape of a wave piercer, and wherein the inner face of each one of the two shells (11) is flat, the inner faces of the two shells (11) being parallel to each other.

16. The system (1, 2) (1, 4) according to claim 3, wherein the front end (15) of each one of the two shells (11) comprises a shape of a wave piercer, and wherein the inner face of each one of the two shells (11) is flat, the inner faces of the two shells (11) being parallel to each other.

17. The system (1, 2) (1, 4) according to claim 2, wherein the lower edge of each one of the two shells (11) includes at least one flat portion (14) intended to be laid on a flat surface once the floating pontoon (1) is out of water.

18. The system (1, 2) according to claim 2, wherein another one (2) of the number of interchangeable drone interface modules of the system (1, 2) is open towards a rear end, towards a front end and towards top and closed towards bottom, said drone interface module (2) forming a docking area (23) of U-shaped cross-section.

19. The system (1, 2) according to claim 3, wherein another one (2) of the number of interchangeable drone interface modules of the system (1, 2) is open towards a rear end, towards a front end and towards top and closed towards bottom, said drone interface module (2) forming a docking area (23) of U-shaped cross-section.

20. A ship (6) comprising at least one system (1, 2) (1, 4) according to claim 1 and at least one drone (3, 5), the ship (6) further comprising one or more of a crane, a davit, or a gantry crane (61) for lowering the system (1, 2) (1, 4) down to sea and raising the system (1, 2) (1, 4) up aboard the ship (6).

* * * * *